US006057775A

United States Patent [19]

Sakurai et al.

[11] Patent Number: 6,057,775

[45] Date of Patent: May 2, 2000

[54] IONIZATION SMOKE DETECTOR

[75] Inventors: Kazuyoshi Sakurai; Nobuyuki Akiyama, both of Tokyo, Japan

[73] Assignee: Nittan Company, Limited, Tokyo, Japan

[21] Appl. No.: 08/927,822

[22] Filed: Sep. 11, 1997

[30] Foreign Application Priority Data

Oct. 11, 1996 [JP] Japan ..... 8-270145

[51] Int. Cl.[7] ..... G08B 17/10

[52] U.S. Cl. ..... 340/629; 340/693.6; 340/693.11

[58] Field of Search ..... 340/629, 628, 340/632, 577, 584, 586, 600, 693.5, 693.6, 693.11, 693.12, 693.9

[56] References Cited

U.S. PATENT DOCUMENTS 3,767,917 10/1973 Lampart et al. ..... 250/384
4,315,594 2/1982 Niederost ..... 340/693.11

FOREIGN PATENT DOCUMENTS 633122 11/1982 Switzerland .
2212657 7/1989 United Kingdom .

*Primary Examiner*—Nina Tong

[57] ABSTRACT

An ionization smoke detector comprising: an inner electrode; an intermediate electrode having an electrode body and an electrode piece extending from the electrode body, facing the inner electrode and connected to a field effect transistor; an outer electrode provided in an opposite side to the inner electrode with respect to the intermediate electrode; and an insulating supporter for supporting the intermediate electrodes to face the inner electrode. The supporter comprises an electrode supporting portion for supporting the intermediate electrode, having a cylindrical peripheral wall to enclose the electrode body of the intermediate electrode, a container for containing the field effect transistor, and a container supporting member for supporting the container by connecting it to the electrode supporting portion; a first notch portion for extending the electrode piece of the intermediate electrode out thereof is formed in the cylindrical peripheral wall, and a second notch portion for extending a lead wire of the field effect transistor stored in the container out of the container is formed at a position facing the first notch portion of the peripheral wall; and the electrode piece extending from the first notch portion is connected to the lead wire extending from the second notch portion.

10 Claims, 9 Drawing Sheets

IONIZATION SMOKE DETECTOR

BACKGROUND OF THE INVENTION

1. Field of the Invention

The present invention relates to an ionization smoke detector for detecting smoke produced due to a fire or the like.

2. Description of Related Art

An ionization smoke detector is generally known as a type of fire detector.

The above conventional ionization smoke detector comprises, for example, a base secured to a ceiling or the like, a detector body removably set to the bottom of the base, and an outer cover for covering the face (bottom) opposite to the base of the detector body.

The detector body comprises a circuit part comprising a printed circuit board on which electronic parts serving as a fire detecting circuit are mounted, a detecting part serving as a sensor for detecting smoke, and a body to which the circuit part and the detecting part are secured and which is removably set to the base.

Furthermore, the detecting part has, for example, an inner electrode having a radiation source, an intermediate electrode set so as to face the inner electrode, and an outer electrode (outer chamber) formed so as to cover the opposite side to the inner electrode of the intermediate electrode, in which the gap between the inner electrode and the intermediate electrode is formed as an almost-closed inner ionization chamber and the gap between the intermediate electrode and the outer chamber is formed as an outer ionization chamber allowing smoke to enter from the outside.

An opening is formed on the intermediate electrode so that the radiation emitted from the radiation source provided for the inner electrode can be also irradiated to the outer ionization chamber.

The ionization smoke detector uses a field effect transistor (hereafter referred to as FET) for detecting a potential change at the joint between the inner and outer ionization chambers and the intermediate electrode is connected to the FET.

Because an ionization smoke detector has a relatively complicate structure having an inner ionization chamber and an outer ionization chamber as described above, the detector has problems that it takes a lot of time to assemble and set the detector and it is difficult to decrease the cost.

For example, in the case of the FET, the insulation between terminals may be deteriorated due to humidity or dust. Therefore, it is preferable to use the FET in a closed state. Moreover, it is necessary that an intermediate electrode connected to the FET is set so as to face an inner electrode under an insulated state. Therefore, it is troublesome to set the FET and intermediate electrode.

The outer chamber is joined to the body by, for example, a plurality of screws. Therefore, the number of screws required to assemble an ionization smoke detector increases and thus, it is troublesome to set an outer chamber.

Further, in the case of an ionization smoke detector, it is necessary to remove the body from the base or the outer cover from the body. Therefore, the cover is set to the body and the body is removably set to the base.

In the case of the structure, when setting the body with the outer cover set on it to the base to assemble an ionization smoke detector, the outer cover set to the body may be removed and thus, the assembling operation is made complex.

SUMMARY OF THE INVENTION

The present invention was developed in view of the above problems.

An object of the present invention is to provide an ionization smoke defector capable of reducing the manufacturing cost by improving the operability of the assembling operation.

That is, in accordance with one aspect of the present invention, the ionization smoke detector comprising: an inner electrode; an intermediate electrode having an electrode body and an electrode piece extending from the electrode body, facing the inner electrode and connected to a field effect transistor; an outer electrode provided in an opposite side to the inner electrode with respect to the intermediate electrode; and an insulating supporter for supporting the intermediate electrode to face the inner electrode; wherein the supporter comprises an electrode supporting portion for supporting the intermediate electrode, having a cylindrical peripheral wall to enclose the electrode body of the intermediate electrode, a container for containing the field effect transistor, and a container supporting member for supporting the container by connecting it to the electrode supporting portion; a first notch portion for extending the electrode piece of the intermediate electrode out thereof is formed in the cylindrical peripheral wall, and a second notch portion for extending a lead wire of the field effect transistor stored in the container out of the container is formed at a position facing the first notch portion of the peripheral wall; and the electrode piece extending from the first notch portion is connected to the lead wire extending from the second notch portion.

In the ionization smoke detector having the above structure, the electrode supporting portion for supporting the intermediate electrode and the container for containing the field effect transistor (hereafter referred to as FET) are connected through the container supporting member; and the first notch portion formed in the cylindrical peripheral wall, for extending the electrode piece of the intermediate electrode out of the cylindrical peripheral wall, is arranged facing the second notch portion formed in the container, for extending a lead wire of the FET out of the container. As a result, it is possible to bring the electrode piece extending from the first notch portion into contact with the lead wire extending from the second notch portion by setting the intermediate electrode to the electrode supporting portion so that the electrode piece of the intermediate electrode extends outwardly through the first notch portion and by containing the FET in the container so that the lead wire of the FET extends outwardly through the second notch portion.

Such a structure enables easy connecting of the lead wire and the electrode piece by, for example, soldering.

In other words, by only setting the intermediate electrode to the electrode supporting portion so that the electrode piece of the intermediate electrode extends outwardly through the first notch portion and by containing the FET in the container so that the lead wire of the FET extends outwardly through the second notch portion, it is possible to determine the positions of the intermediate electrode and the FET so that the electrode piece is brought into contact with the lead wire, and to perform positioning of the intermediate electrode and the FET very easily.

Therefore, it is possible to improve the operability for assembling an ionization smoke detector and to decrease the production costs of the ionization smoke detector.

Further, it is possible to use generally known components as the radiation source, the inner electrode, the intermediate electrode, and the outer electrode in the ionization smoke detector.

It is preferable to form the intermediate electrode into, for example, a doughnut-shape having an opening at its center so that radiation can be efficiently emitted to the outer electrode side from the radiation source of the inner electrode.

Further, it is preferable that the supporter is made of a resin with a high resistivity and that the electrode supporting portion, the container, and the container supporting member are integrally formed.

Preferably, the electrode supporting portion of the supporter comprises an electrode mount for supporting the intermediate electrode, having a projection thereon which passes through an attachment hole formed in the intermediate electrode and an upper end of which is deformed to secure the intermediate electrode to the electrode mount so that the intermediate electrode faces the inner electrode. The intermediate electrode may be secured to the electrode mount by melting an upper end of the projection passing through the attachment hole of the intermediate electrode while mounting the intermediate electrode on the electrode mount.

According to the above structure, it is possible to easily perform positioning of the intermediate electrode by inserting the projection into the attachment hole of the intermediate electrode when mounting the intermediate electrode on the electrode mount.

When melting the upper end of the projection passing through the attachment hole of the intermediate electrode, because the intermediate electrode can be secured to the electrode mount, it is unnecessary to use a joining member such as a screw or the like and it is possible to decrease the number of joining members for fastening such as screws used to assemble an ionization smoke detector and to easily fix the intermediate electrode, in comparison with the case of using screws.

Therefore, it is possible to improve the operability for assembling an ionization smoke detector and to decrease the cost of the ionization smoke detector.

It is preferable that the electrode mount is a portion of the supporter and is made of a resin with a high resistivity, and that the projection is made of a material to be melted by heat, for example, a resin integrated with the electrode mount.

Further, it is preferable to use two or more attachment holes and two or more projections in order to position the intermediate electrode.

Preferably, the container supporting member is arranged apart from the connected portion between the electrode piece extending from the first notch portion and the lead wire extending from the second notch portion.

According to the above structure, it is possible to carry out the joining operation easily because the soldering operation for joining the electrode piece with the lead wire is not interrupted by the supporting member.

When the electrode piece and the lead wire are connected to each other by soldering and a material to be easily melted or deformed due to heat, e.g., thermoplastic resin or the like, is used as the container supporting member, it is possible to prevent the container supporting member from melting or deforming due to heat because the container supporting member is arranged apart from the connected portion between the electrode piece extending from the first notch portion and the lead wire extending from the second notch portion.

Generally, when soldering is performed from the opening side of the container of the FET, there is a large possibility of entrance of flux and the like contained in solder into the container through the opening and of adhesion of the flux to the gap between terminals of the FET to deteriorate the insulation performance thereof. However, according to the above structure, the problem can be solved because soldering can be performed from the side opposite to the opening of the container without being interrupted by the supporting member.

In accordance with another aspect of the present invention, the ionization smoke detector comprising: a detecting part having an inner electrode, an intermediate electrode facing the inner electrode, and an outer chamber functioning as an outer electrode provided in an opposite side to the inner electrode with respect to the intermediate electrode; a circuit part having a printed circuit board on which an electronic part for detecting smoke in accordance with an output from the detecting part is mounted; and a supporting body to which the detecting part and the circuit part are installed; wherein the printed circuit board is secured to the supporting body, the outer chamber and the printed circuit board are in contact with and electrically connect to each other at least at one position, and a fitting means to be fitted to the supporting body is provided on the outer chamber.

In the case of the ionization smoke detector having the above structure, connection by a screw or bolt is required for at least one place because the outer chamber and the printed circuit board are joined while being electrically connected with each other at at least one place. However, because the fitting means for fitting the outer chamber to the supporter is provided, it is possible to securely fix the outer chamber to the supporter by connecting the printed circuit board secured to the supporter with the outer chamber at one place and by fitting the fitting means of the outer chamber to the supporter at another place.

Therefore, it is unnecessary to connect the outer chamber with the supporter by screws or bolts at a plurality of places and moreover, it is possible to decrease the number of connecting members such as screws, bolts or the like, to decrease the time necessary for applying a plurality of screws or bolts, and to improve the operability for assembling the ionization smoke detector.

The outer chamber functions as an outer electrode. Therefore, it is necessary that the outer chamber has an electrical conductivity. Moreover, in order to fit the fitting means to the supporter, it is necessary that the portion of the supporter fitting to the fitting means or the fitting means is elastically deformable.

Therefore, it is necessary that the outer electrode is made of metal or electrically conductive resin. From a viewpoint of formation, assembling and the like, it is preferable to adopt an electrically conductive resin for the outer electrode.

A resin obtained by dispersing a conductive material such as metallic fibers in the resin or a resin made of conductive organic substance can be used for the conductive resin.

In order to contact and electrically connect the printed circuit board and the outer chamber to each other, it is necessary that the contact surface of the printed circuit board and that of the outer chamber are conductive.

Further, when the outer chamber is made of a conductive resin obtained by dispersing a conductive material in the resin, it is necessary that the dispersed conductive material is exposed on the contact surface of the outer chamber.

Preferably, the circuit part and the detecting part except the outer chamber are arranged between the supporting body and the outer chamber disposed under the supporting body while the bottom of the detecting part is covered with the outer chamber, and the fitting means is provided to protrude outwardly from the peripheral portion of the outer chamber and a fitting hole in which the fitting means is fitted is formed at a position corresponding to the fitting means of the supporting body.

According to the ionization smoke detector having the above structure, when water is collected on the upper surface of the supporting body due to dew condensation or the like, the water flows from the fitting hole to the lower side of the supporting body. Because the position of the fitting hole corresponds to the position of the fitting means provided so as to protrude outwardly from the periphery of the outer chamber, the water flowing through the fitting hole of the supporting body flows to the outside of the periphery of the outer chamber. Thus, the water does not enter the circuit part which is set between the supporting body and the outer chamber disposed under the supporting body while the lower surface of the circuit part is covered with the outer chamber, and does not enter the side of the detecting part except the outer chamber.

That is, it is possible to flow the water collected on the supporting body due to dew condensation, to the lower side of the supporting body without contacting the circuit part or the detecting part and to prevent the circuit part and the detecting part from being influenced by dew condensation.

The above structure is particularly effective when an ionization smoke detector is set to a ceiling. For example, when water is collected on the supporting body set to a ceiling through a base due to dew condensation or the like, it is possible to discharge the water without adverse effect on the circuit part or detecting part.

It is necessary that the fitting hole passes through the supporting body vertically in order to flow the water on the supporting body to the lower side of the supporting body.

A surface-mounting-type of a light-emitting device for giving an operational indication is preferably provided on a surface of the printed circuit board facing the outer chamber, a through-hole is formed at a position corresponding to the light-emitting device in the outer chamber, a light-transmissive member for introducing the light emitted from the light-emitting device out of the outer chamber is disposed in the through-hole, and the through-hole is blocked by the light-transmissive member.

According to the ionization smoke detector having the above structure, because one of surface-mountable type is used as a light-emitting device and the electrodes of the light-emitting device are soldered to the printed circuit board not through a lead wire, it is possible to prevent the position or optical axis, of the light-emitting device from deviation caused by bending of the lead wire.

Further, it is possible to lead the light emitted from the light-emitting device set on the printed circuit board to the outside of the outer chamber by the light-transmissive member provided in the through-hole of the outer chamber. Therefore, it is possible to recognize the light emitted from the light-emitting device on the printed circuit board from the outside even if the printed circuit board is covered with the outer chamber.

Because the light-transmissive member blocks the through-hole of the outer chamber, it is possible to prevent dirt and dust from entrance through the through-hole of the outer chamber.

If a discrete part having a lead wire is used as the light-emitting device, the light-emitting device will excessively protrude from the printed circuit board. For this reason, it is preferable to form a through-hole for the light-emitting device in the outer chamber and to insert the light-emitting device into the through-hole when covering the neighborhood of the surface of the printed circuit board with the outer chamber.

Thus, it is possible to emit the light of the light-emitting device to the outside of the outer chamber. Because there is the possibility of deviation of the position of the light-emitting device caused by bending of a lead wire or the like, it is preferable to make the through-hole of the outer chamber larger than the light-emitting device, in view of operability. Although there would be the possibility of entrance of dirt and dust through the gap between the through-hole and the light-emitting device, it is possible not only to improve the operability of assembling but to prevent dirt and dust from entrance through the through-hole completely by using a surface-mounting-type of light-emitting device, as described above, by forming the through-hole for emitting the light of the light-emitting device outward on the outer chamber and by closing the through-hole with a light-transmissive member.

In this embodiment, any type of light-emitting device can be basically used as long as the device can be surface-mounted. For example, a light-emitting diode can be used.

The surface-mountable type is a type which does not have a lead wire basically and the electrode portion of which can be directly soldered to a printed circuit board.

Although a transparent member can be basically used as the light-transmissive member, it is preferable to use a member capable of efficiently leading the light of a light-emitting device on a printed circuit board to the outside of an outer chamber.

In accordance with another aspect of the present invention, the ionization smoke detector comprising: a base secured to a portion such as a ceiling, a detector body removably set to the base and having a smoke detecting means for detecting smoke, and an outer cover for covering the opposite side to the base of the detector body; wherein the detector body has a supporting body for supporting the smoke detecting means, which is removably set to the base and to a peripheral portion of which an outer cover is held; a fitting piece elastically deformable toward the center of the supporting body, having a protrusion protruding outwardly, and extending toward the base is provided on the peripheral portion of the supporter; a cylindrical portion surrounding the peripheral portion of the supporter is formed on an outer peripheral portion of the outer cover and a fitting portion to be fitted to the protrusion of the fitting piece is formed on an inner surface of the cylindrical portion; and the base is provided with a preventing portion for preventing an elastic deforming of the fitting piece from elastically deforming toward a central side of the supporting body, the preventing portion being arranged in a central side of the fitting piece so as to overlap with the fitting piece.

Preferably, the fitting piece is made of a synthetic resin having elasticity and flexibility and has a U-shaped cross section which is elastically deformable easily by a finger.

According to the ionization smoke detector having the above structure, it is possible to set the outer cover to the supporting body by fitting the approximately plate-like protrusion of the fitting piece provided on the periphery of the supporting body to the fitting portion on the inner surface of the cylindrical portion of the outer cover covering the circumference of the supporting body. In this case, by elastically deforming the fitting piece toward the center of the supporting body so that the protrusion of the fitting piece exceeds the fitting portion of the outer cover, the fitting piece returns to the original state from the elastically deformed state and the protrusion of the fitting piece fits with the fitting portion of the cylindrical portion. Further, by elastically deforming the fitting piece, the fitting state can be released.

When setting the supporting body to the base while the outer cover is set to the supporting body, because the preventing portion of the base prevents the fitting piece from elastically deforming, under the state, however, it is impossible to elastically deform the fitting piece of the supporting body toward the center of the supporting body and to release the fitting state (engagement) between the protrusion of the fitting piece and the fitting portion of the outer cover.

According to the ionization smoke detector having the above structure, when removing the supporting body from the base, the outer cover is not removed from the supporting body before the supporting body separates from the base. Therefore, it is possible to prevent a trouble that the outer cover is removed before removing the supporting body from the base.

Further, when performing an performance test of the ionization smoke detector while the supporting body is installed to the base, it is possible to prevent the outer cover from dropping even if any member is erroneously brought in contact with the ionization smoke detector.

Further, because the fitting piece extends to the base side, it is possible to easily apply an operator's finger to the fitting piece while the supporting body is removed from the base. Therefore, it is possible to elastically deform the fitting piece toward the center of the supporting body to release the fitting state between the fitting piece and the fitting portion of the supporting body by applying the finger to the fitting piece directly and thereby to remove the outer cover from the supporting body easily.

That is, because it is unnecessary to use a tool such as a screwdriver or the like to remove the outer cover from the supporting body, it is possible to improve the operability for removing the outer cover from the supporting body for maintenance.

The materials of the base, the supporting body, and the outer cover are not restricted. However, in view of molding of them, insulation from the detecting means, it is preferable that they are made of synthetic resins. Furthermore, it is preferable that the fitting piece can be easily elastically deformed toward the center of the supporting body by a finger. For example, it is preferable that the joint between the supporting body and the fitting piece has a cross section of U-shape.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

An ionization smoke detector according to an embodiment of the present invention will be explained with reference to the accompanying drawings, as follows.

Figure 1:
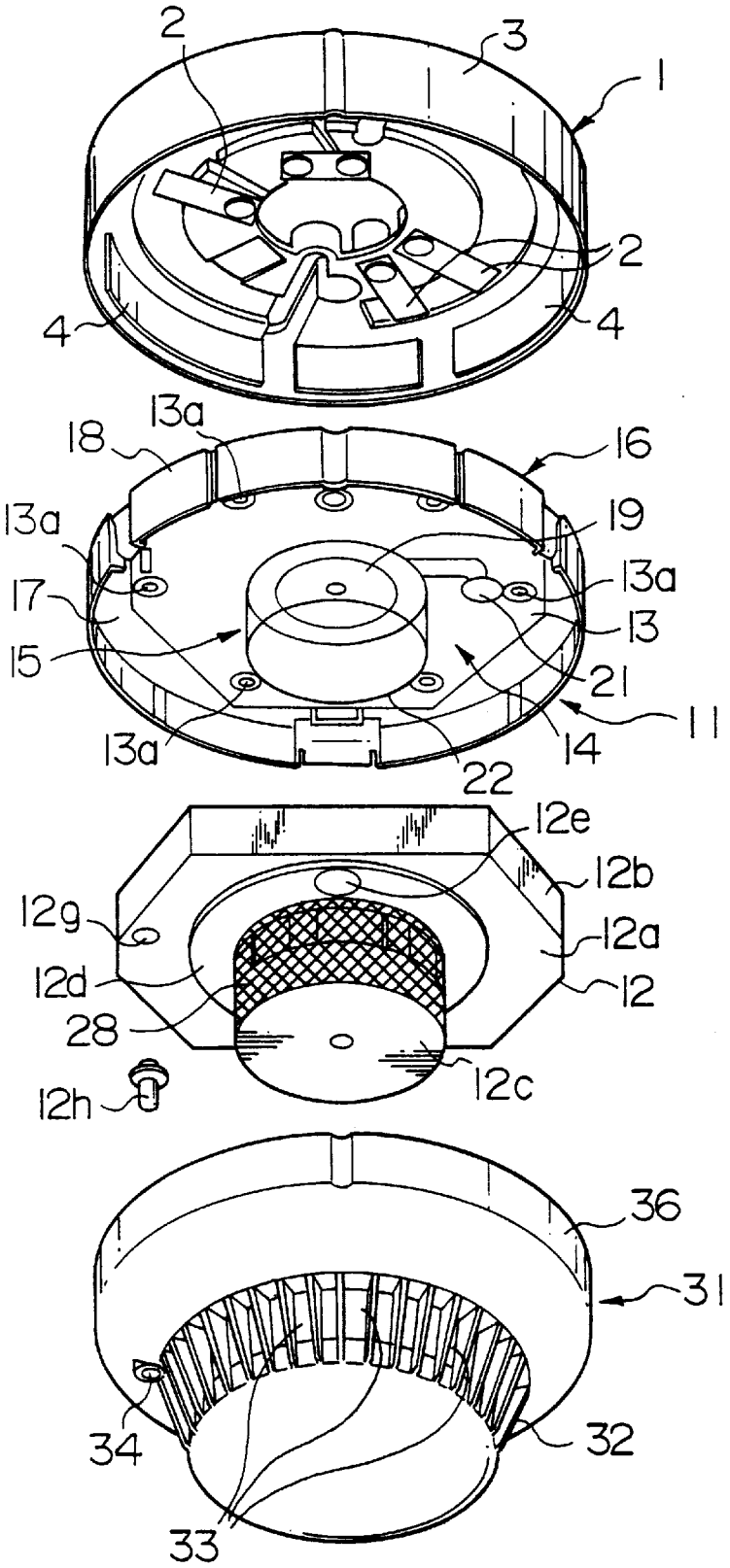
FIG. 1 is a development perspective view showing an ionization smoke detector according to an embodiment of the invention.

FIG. 1 shows a development of the ionization smoke detector according to the embodiment.

As shown in FIG. 1, the ionization smoke detector comprises a base 1 to be secured to an inside of a building such as a ceiling, a detector body 11 removably set to the base 1, and an outer cover 31 for covering the opposite side with respect to the base 1 of the detector body 11.

In FIG. 1, an outer chamber 12 of the detector body 11 is illustrated by developing it from the detector body 11.

The base 1 is used to set the ionization smoke detector, for example, on a ceiling and serves as a type of socket for electrically connecting the detector body 11 with a power supply or a fire signal receiver. The base 1 is formed in a thin cylindrical shape and a plurality of terminals 2 for electrically connecting and supporting the detector body 11 are arranged on the inside of the base 1.

The detector body 11 comprises a circuit part 14 having a printed circuit board 13 on which electronic parts (not illustrated) for constituting a smoke detecting circuit are mounted, a detecting part 15 (including the outer chamber 12) connected to the circuit part 14 and serving as a sensor for detecting smoke, and a body 16 serving as a supporting member for supporting the circuit part 14 and the detecting part 15.

The body 16 comprises a disk portion 17 to which the printed circuit board 13 of the circuit part 14 and the outer chamber 12 of the detecting part 15 are set and a peripheral wall 18 formed to have an approximately cylindrical shape around the disk portion 17.

In the circuit part 14, the printed circuit board 13 can be secured by a plurality of screws 13*a* to the bottom of the disk portion 17 of the body 16. When securing the printed circuit board 13 to the bottom of the disk portion 17 of the body 16 by using screws, a plurality of pawl-like terminals (not illustrated) are arranged on the upper surface side of the disk portion 17 so that the printed circuit board 13 and the pawl-like terminals are connected to the disk portion 17 while sandwiching the disk portion 17 between the printed circuit board 13 and the pawl-like terminals.

The pawl-like terminals are connected with the printed circuit board 13. Moreover, when setting the detector body 11 to the base 1, the pawl-like terminals are fitted to the terminals 2 of the base 1 to electrically connect the base 1 with the detector body 11 and to removably connect the detector body 11 to the base 1.

The detecting part 15 comprises an inner electrode 19 having a radiation source, an intermediate electrode 20 (omitted in FIG. 1 but illustrated in FIG. 2) set so as to face the inner electrode 19, an insulating supporter 22 facing the inner electrode 19 to support the intermediate electrode 20 and to support an FET 21 which is connected to the intermediate electrode 20, and an outer chamber 12 for covering the printed circuit board 13 and the supporter 22 set on the printed circuit board 13, and the like.

The outer cover 31 protects the detector body 11 while smoke can enter the detector body 11 side, which is formed like a circular lid. Moreover, a cylindrical protrusion 32 protruding downward to store the detecting part 15 of the detector body 11 is formed at the central portion of the outer cover 31 and a lot of incoming openings 33 for enabling circulation of smoke are formed in the outer periphery of the cylindrical protrusion 32.

An embodiment of the detecting part 15 of the ionization smoke detector according to the present invention will be explained in detail, as follows.

The inner electrode 19 of the detecting part 15 is connected to the circuit part 14 which is secured to approximately the central portion of the printed circuit board 13.

Figure 3A:
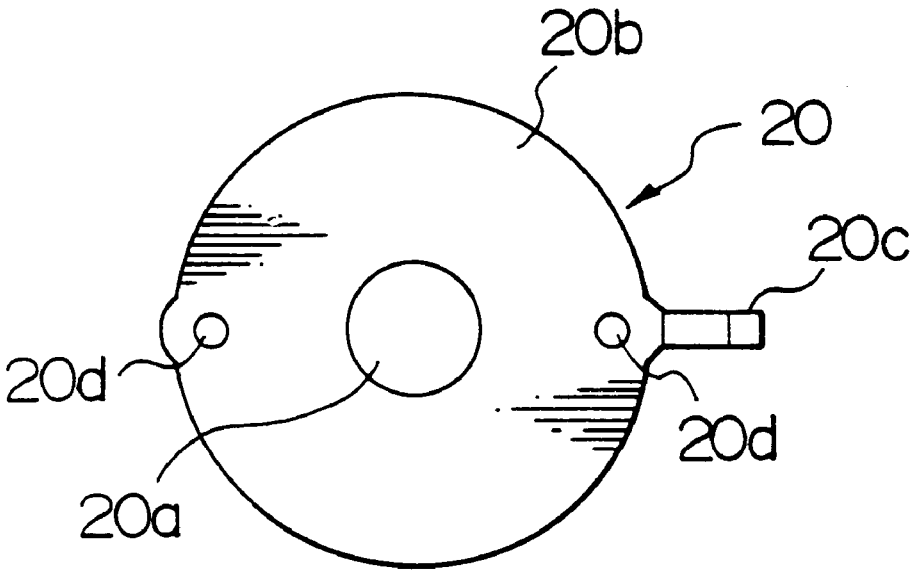
FIG. 3A is a plan view of the intermediate electrode of the ionization smoke detector according to the embodiment.

The intermediate electrode 20 of the detecting part 15 comprises a disc-shaped or doughnut-shaped electrode body 20*b* having a circular opening 20*a* at its central portion and an electrode piece 20*c* extending outward from the electrode body 20*b*, as shown in FIG. 3A.

Two attachment holes 20*d* and 20*d* which are used when the electrode body 20*b* is positioned and secured to the supporter 22 are formed at the right and left of the opening 20*a* respectively.

Figure 3B:
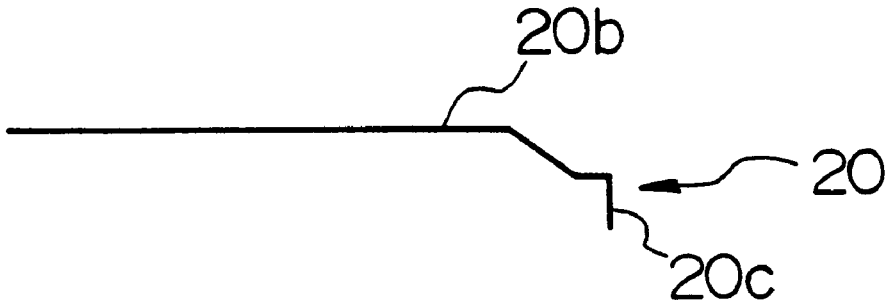
FIG. 3B is a side view thereof.

The electrode piece 20*c* extends downward at an angle from the electrode body 20*b* and the top end thereof is curved downward vertically, as shown in FIG. 3B.

Figure 2A:
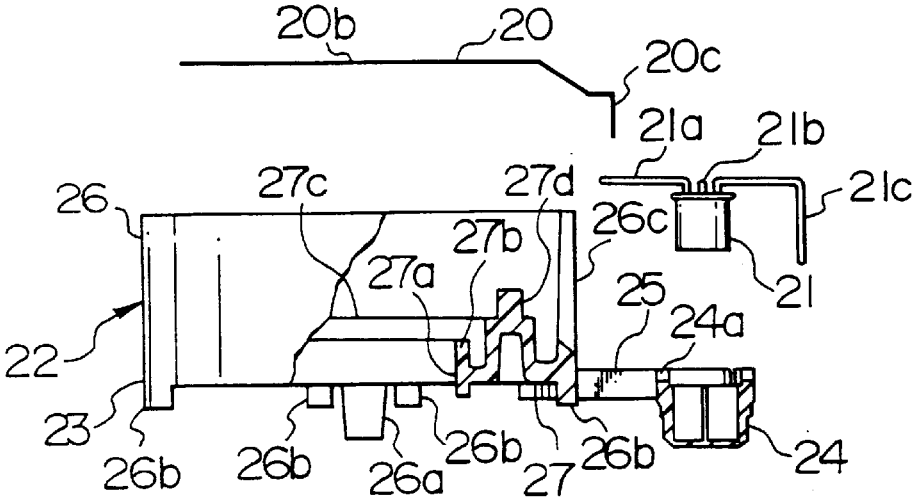
FIGS. 2A to 2C are sectional views for explaining a manner of installing an intermediate electrode and an FET to a supporter of the ionization smoke detector according to the embodiment.
Figure 2B:
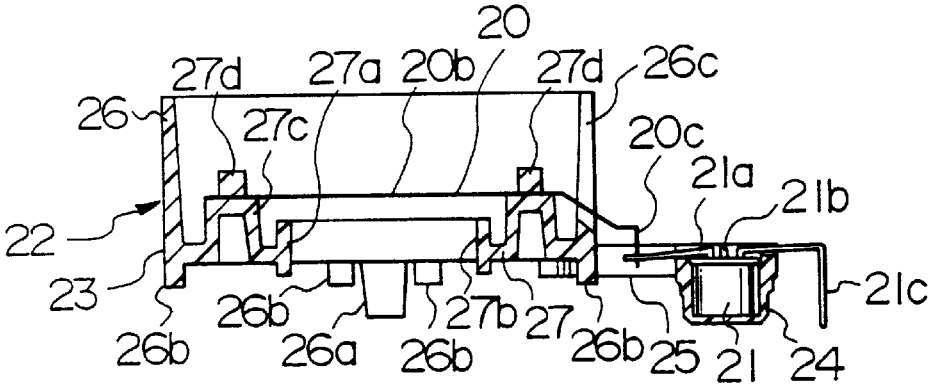
Figure 2C:
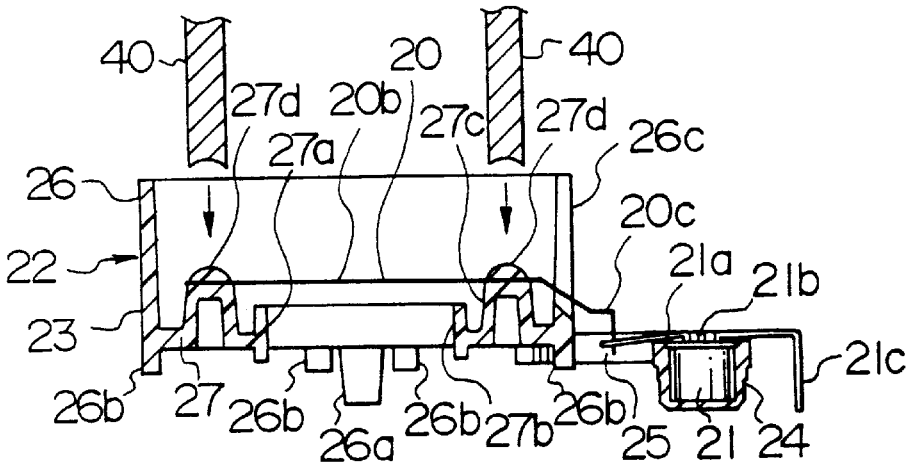

The top end of the electrode piece 20*c* is soldered to a lead wire 21*a* among three lead wires 21*a*, 21*b*, and 21*c* of the FET 21, as shown in FIG. 2C.

The supporter 22 of the detecting part 15, as shown in FIGS. 2A to 2C and FIGS. 4A to 4C, comprises an electrode supporting portion 23 for supporting the intermediate electrode 20 while facing the inner electrode 19, an FET storing portion 24 for storing the FET 21, and a supporting member 25 for connecting the FET storing portion 24 which is set separately from the electrode supporting portion 23, to the electrode supporting portion 23 to support it.

The electrode supporting portion 23 of the supporter 22 comprises a cylindrical peripheral wall 26 and a bottom portion 27 formed in the lower end of the peripheral wall 26.

On the peripheral wall 26, fitting legs 26*a* and 26*a* fitting to not-illustrated attachment holes which are formed in the printed circuit board 13, a plurality of leg portions 26*b* contacting with the upper surface of the printed circuit board 13, and a slit-like first notch portion 26*c* which is set so that the electrode piece 20*c* of the intermediate electrode 20 extends outward from the inside of the peripheral wall 26, are formed.

The supporter 22 can be secured to the printed circuit board 13 by the fitting legs 26*a* and 26*a* and the leg portions 26*b*.

An opening 27*a* in which the inner electrode 19 is arranged, a cylindrical inner wall portion 27*b* surrounding the inner electrode 19 arranged in the opening 27*a*, a cylindrical electrode mount 27*c* provided at the circumference of the inner wall portion 27*b*, and two projections 27*d* and 27*d* projecting on the mount 27*c* are formed on the bottom portion 27.

The opening 27*a* is formed with a circular shape at the central portion of the bottom portion 27 so that the inner electrode 19 secured to the printed circuit board 13 is arranged in the opening 27*a* when setting the supporter 22 to the printed circuit board 13.

The inner wall portion 27*b* is formed while protruding to the lower side of the bottom portion 27 so that the height of the inner wall portion 27*b* is smaller than that of the mount 27*c*, as shown in FIGS. 2A and 2B.

The mount 27*c* is formed with a cylindrical shape so that the peripheral portion of the intermediate electrode 20 can be mounted on the upper side of the mount 27*c*.

By mounting the intermediate electrode 20 on the upper surface of the mount 27*c*, as shown in FIG. 2B, the mount 27*c* is covered with the intermediate electrode 20 and the gap between the inner electrode 19 and the intermediate electrode 20 in the mount 27*c* serves as an approximately closed inner ionization chamber.

The projections 27*d* and 27*d* are formed so that they protrude upward at right and left positions on the outer periphery of the mount 27*c*. In the projections 27*d* and 27*d*, the lower portion up to the same height as the mount 27*c* is thickly formed and the upper portion is thinly formed correspondingly to the attachment holes 20*d* and 20*d* of the intermediate electrode 20 shown in FIG. 3A.

That is, each of the projections 27*d* and 27*d* has a step formed at the height of the mount 27*c*.

When mounting the intermediate electrode 20 on the mount 27*c*, the projections 27*d* and 27*d* are inserted into the attachment holes 20*d* and 20*d* of the intermediate electrode 20 to perform positioning of the intermediate electrode 20. After mounting the intermediate electrode 20 on the mount 27*c*, the intermediate electrode 20 can be secured to the supporter 22 by pressing the projections 27*d* and 27*d* downward by using a suitable pressing member 40 while heating the upper ends of them to melt the upper ends, the diameter thereof is enlarged, as shown in FIG. 2C.

The FET storing portion 24 is formed with a cylindrical shape having a bottom and an upper opening, as shown in FIG. 2A.

The FET storing portion 24 is integrally joined to the electrode supporting portion 23 through the supporting member 25 so that the lower end of the FET storing portion 24 becomes lower than the lower ends of the leg portions 26*b* of the electrode supporting portion 23 and the FET storing portion 24 is inserted into a through-hole (not illustrated) formed on the printed circuit board 13 when securing the electrode supporting portion 23 to the printed circuit board 12 to prevent the FET storing portion 24 from excessively protruding from the printed circuit board 13 and the lengths of the lead wires 21*b* and 21*c* can be decreased when soldering two lead wires 21*b* and 21*c* among the lead wires 21*a*, 21*b*, and 21*c* of the FET 21 to be stored in the FET storing portion 24.

Figure 4A:
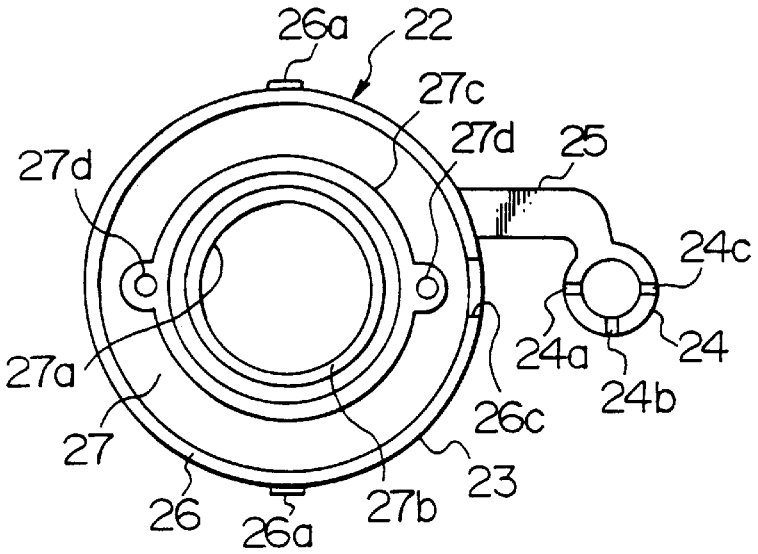
FIG. 4A is a plan view of the supporter of the ionization smoke detector according to the embodiment.
Figure 4B:
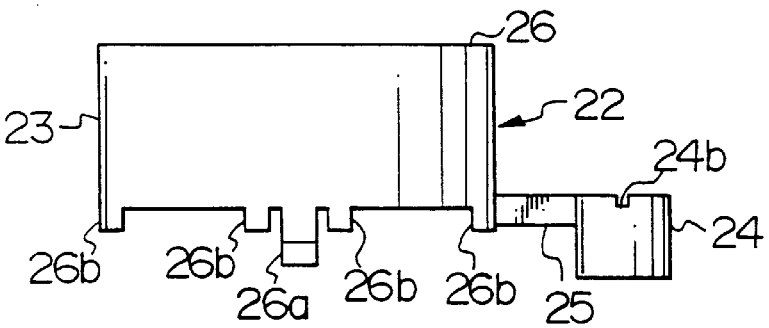
FIG. 4B is a side view thereof.
Figure 4C:
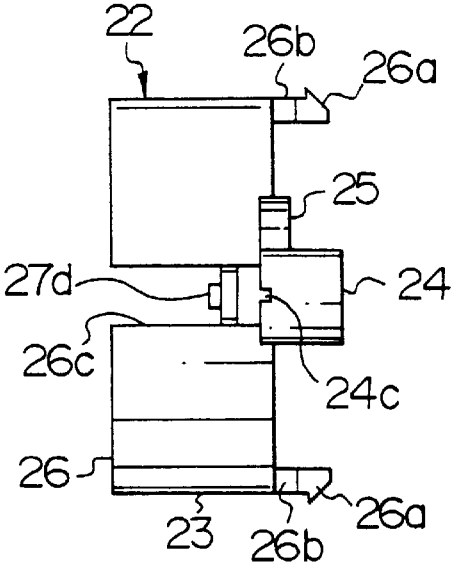
FIG. 4C is a front view thereof.

Further, as shown in FIG. 4A, three second notch portions 24*a*, 24*b*, and 24*c* which are opened upward and have grooves formed from the inner periphery to the outer periphery, are formed in the upper surface of the cylindrical FET storing portion 24.

Three lead wires 21*a*, 21*b*, and 21*c* of the FET 21 which is stored in the FET storing portion 24 are disposed in the second notch portions 24*a*, 24*b*, and 24*c*, respectively. The upper opening of the FET storing portion 24 is covered by a sealing material after storing the FET 21 therein so that the FET 21 is sealed in the FET storing portion 24.

The second notch portion 24*a* in which the lead wire 21*a* connected to the intermediate electrode 20 among the three second notch portions 24*a*, 24*b*, and 24*c* of the FET storing portion 24 is formed so as to face the first notch portion 26*c* of the peripheral wall 26.

When the lead wire 21*a* of the FET 21 stored in the FET storing portion 24 is extended outward from the second notch portion 24*a* and the electrode piece 20*c* of the intermediate electrode 20 supported by the electrode supporting portion 23 is extended outward from the first notch portion 26*c*, the lead wire 21*a* of the FET 21 is brought into contact with the electrode piece 20*c* of the intermediate electrode 20.

One end of the supporting member 25 is joined to the peripheral wall 26 of the electrode supporting portion 23 at a position slightly distant from the first notch portion 26*c*, and the other end of the member 25 is curved toward the first notch portion 26*c* and joined to the FET storing portion 24 at a position slightly distant from the second notch portion 24*a*.

That is, the supporting member 25 is formed in a curved shape so as to separate from a portion where the lead wire 21*a* of the FET 21 is joined with the electrode piece 20*c* of the intermediate electrode 20. As the result, it is possible to prevent soldering of the lead wire 21*a* of the FET 21 and the electrode piece 20*c* of the intermediate electrode 20 from interruption by the supporting member 25 and moreover, to prevent the supporting member 25 from melting or deforming due to the heat of soldering.

Further, the supporting member 25 having such a curved shape enables performance of the soldering from the side opposite to the opening of the FET storing portion 24, as the result, it is possible to prevent insulation between the terminals of the FET 21 from deterioration due to adhesion of flux. On the contrary, if soldering is performed from the side of the opening of the FET storing portion 24, there is a large possibility of flux contained in solder adhered onto the terminals of the FET 21 through the opening of the FET storing portion 24, to deteriorate the insulation of the terminals.

The outer chamber 12 of the detecting part 15 is made of a well-known conductive resin.

Figure 9:
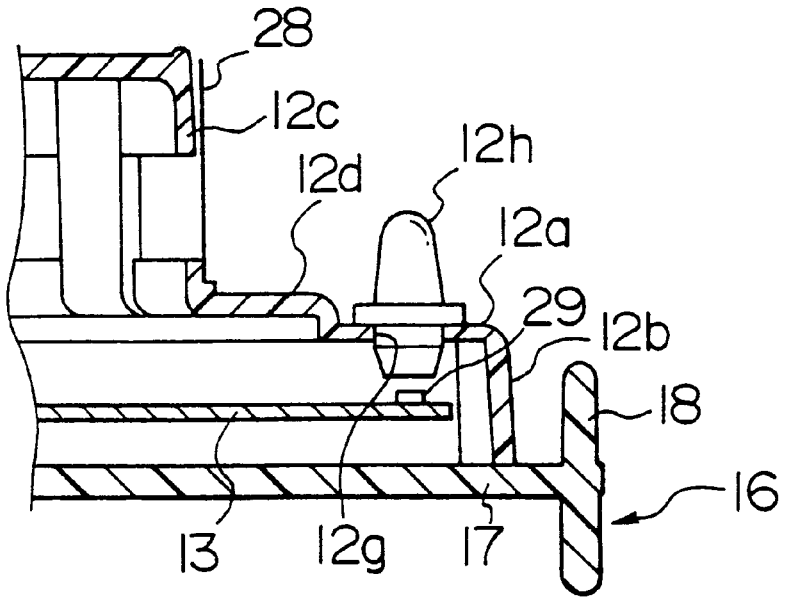
FIG. 9 is a vertically sectional view of the principal portion of the detector body.

As shown in FIG. 1, the outer chamber 12 comprises; an approximately hexagonal plate portion 12*a* covering the surface of the approximately hexagonal printed circuit board 13, a wall portion 12*b* formed around the plate portion 12*a* to cover the circumference of the printed circuit board 13, a cylindrical portion 12*c* having a bottom formed at the central portion of the plate portion 12*a* so as to cover the electrode supporting portion 23 of the supporter 22 on the printed circuit board 13, a cylindrical mesh 28 covering the outer periphery of the cylindrical portion 12*c*, a step portion 12*d* formed around the cylindrical portion 12*c* so that it becomes a step lower than the plate portion 12*a*, a cylindrical portion 12*e* for screw provided for the step portion 12*d*, a pawl portion 12*f* (illustrated in FIG. 5) provided for the body 16 to serve as a fitting means to be fitted into a fitting hole 17*a* (illustrated in FIG. 7) which will be described later while protruding from the wall portion 12*b*, a lens attachment hole 12*g* provided at a position facing a light-emitting diode 29 (hereafter, referred to as an LED which is illustrated in FIG. 9) surface-mounted on the printed circuit board 13, and a red lens 12*h* fitted in the lens attachment hole 12*g*.

Figure 5:
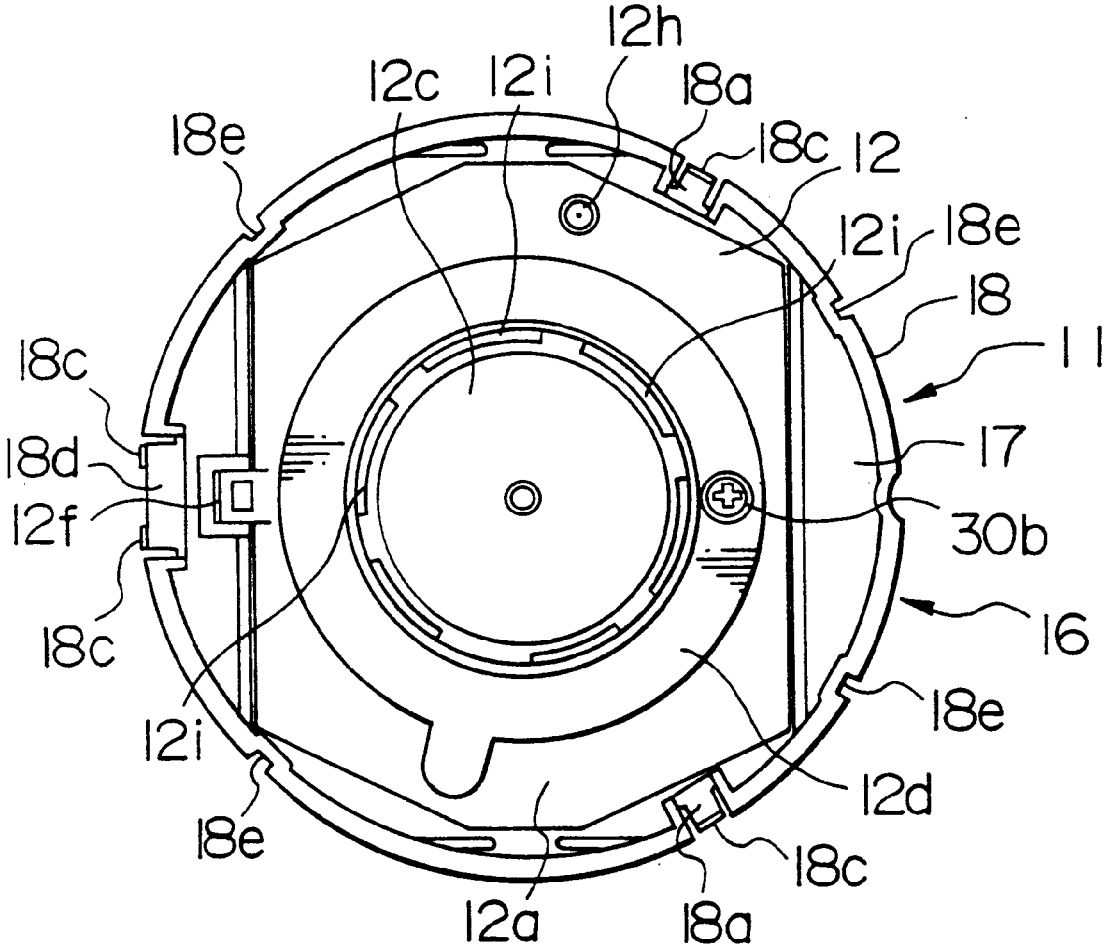
FIG. 5 is a plan view of a detector body of the ionization smoke detector according to the embodiment.
Figure 6:
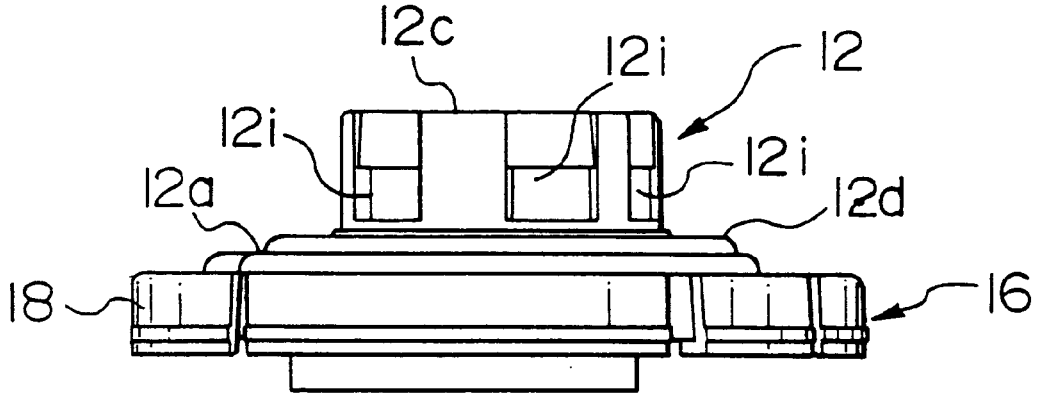
FIG. 6 is a side view of the detector body.
Figure 8:
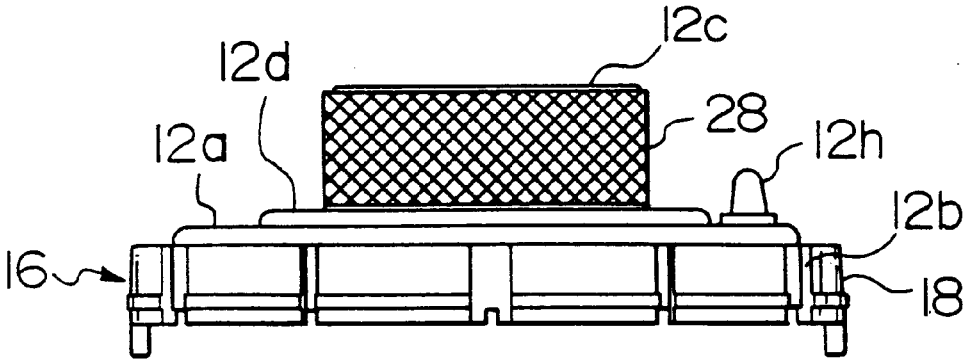
FIG. 8 is a front view of the detector body.

In the outer periphery of the cylindrical portion 12*c*, a lot of incoming openings 12*i* for permitting smoke to enter the outer chamber 12 are formed, as shown in FIGS. 5 and 8.

Moreover, the mesh 28 prevents an insect or the like from coming inside through the incoming openings 12*i*, as shown in FIGS. 1 and 8.

Figure 7:
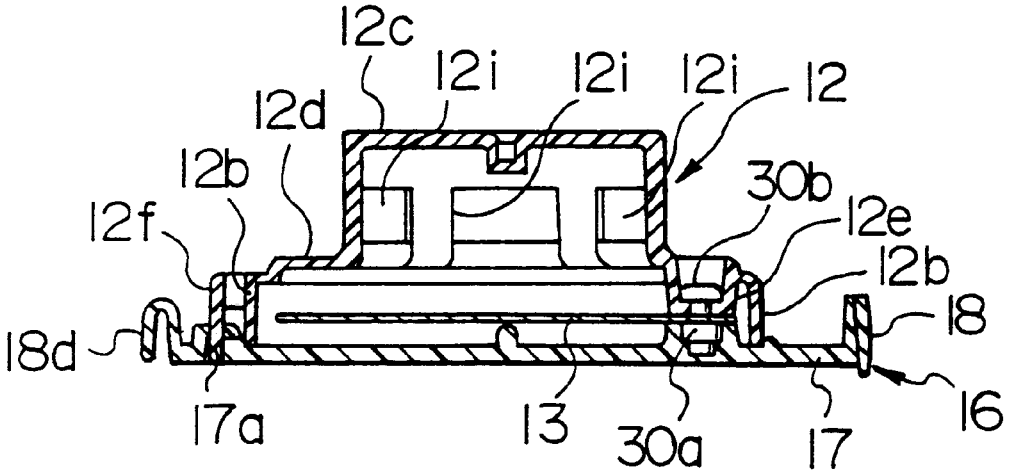
FIG. 7 is a vertically sectional view of the detector body.

As shown in FIG. 7, the cylindrical portion 12*e* for screw is formed at a position of the outer chamber 12 in the opposite side to the pawl portion 12*f* and the lower end surface thereof is brought into contact with a conductor on the surface of the printed circuit board 13 so as to electrically connect the outer chamber 12 with the printed circuit board 13.

A through-hole (not illustrated) is formed at a portion corresponding to the cylindrical portion 12*e* for screw, of the printed circuit board 13 and a nut 30*a* is set to a portion corresponding to the cylindrical portion 12*e* for screw of the body 16 so that it cannot rotate. By inserting the screw 30*b* from the cylindrical portion 12*e* for screw to pass through the printed circuit board 13 and screwing the screw 30*b* into the nut 30*a*, the outer chamber 12 can be secured to the printed circuit board 13.

Because the printed circuit board 13 is screwed to the body 16, the outer chamber 12 can be joined with the body 16 by fastening the printed circuit board 13 and the outer chamber 12 by using the screw at the cylindrical portion 12*e* for screw.

The pawl portion 12*f* is protruded sideward from the wall portion 12*b* beyond the outer chamber 12 and extended to the side of the body 16.

The top end of the pawl portion 12*f* is fitted to the fitting hole 17*a* formed in the disk portion 17 of the body 16 so as to secure the outer chamber 12 to the body 16.

Because the pawl portion 12*f* is protruded beyond the outer chamber 12 and the fitting hole 17*a* of the body 16 is formed outside of the wall portion 12*b* of the outer chamber 12, when the water collected on the upper side (illustrations are turned upside down in FIGS. 6 to 9) of the body 16 due to dew condensation enters the body 16 through the fitting hole 17*a*, the water flows through the outside of the wall portion 12*b* of the outer chamber 12. Therefore, parts of the circuit part 14 and those of the detecting part 15 mounted on the printed circuit board 13 in the outer chamber 12 are not adversely affected by the water flowing through the fitting hole 17*a*.

As shown in FIGS. 8 and 9, the red lens 12*h* is set to the lens attachment hole 12*g*, as described above so as to introduce the light of the LED 29 surface-mounted on the printed circuit board 13 to the outside of the outer chamber 12. Further, the lens attachment hole 12*g* is completely blocked by the red lens 12*h* so that dust does not come in through the lens attachment hole 12*g*.

As shown in FIG. 1, a through-hole 34 into which the upper end of the red lens 12*h* is inserted is formed at a position corresponding to the lens attachment hole 12*g* of the outer cover 31 so that the light of the operation indicating LED 29 surface-mounted on the printed circuit board 13 is introduced up to the outside of the outer cover 31 and can be confirmed from the outside of the outer cover 31.

Next, the structure for setting the base 1, the body 16, and the outer cover 31 of the ionization smoke detector according to the embodiment of the present invention will be described, as follows.

Figure 10A:
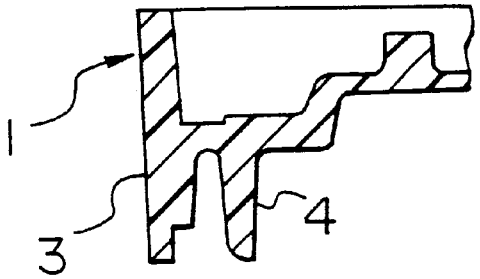
FIGS. 10A, 10B and 10C are vertically sectional views of the principal portion of the base, the body and the outer cover, in the attachment structure of the ionization smoke detector, respectively.
Figure 11:
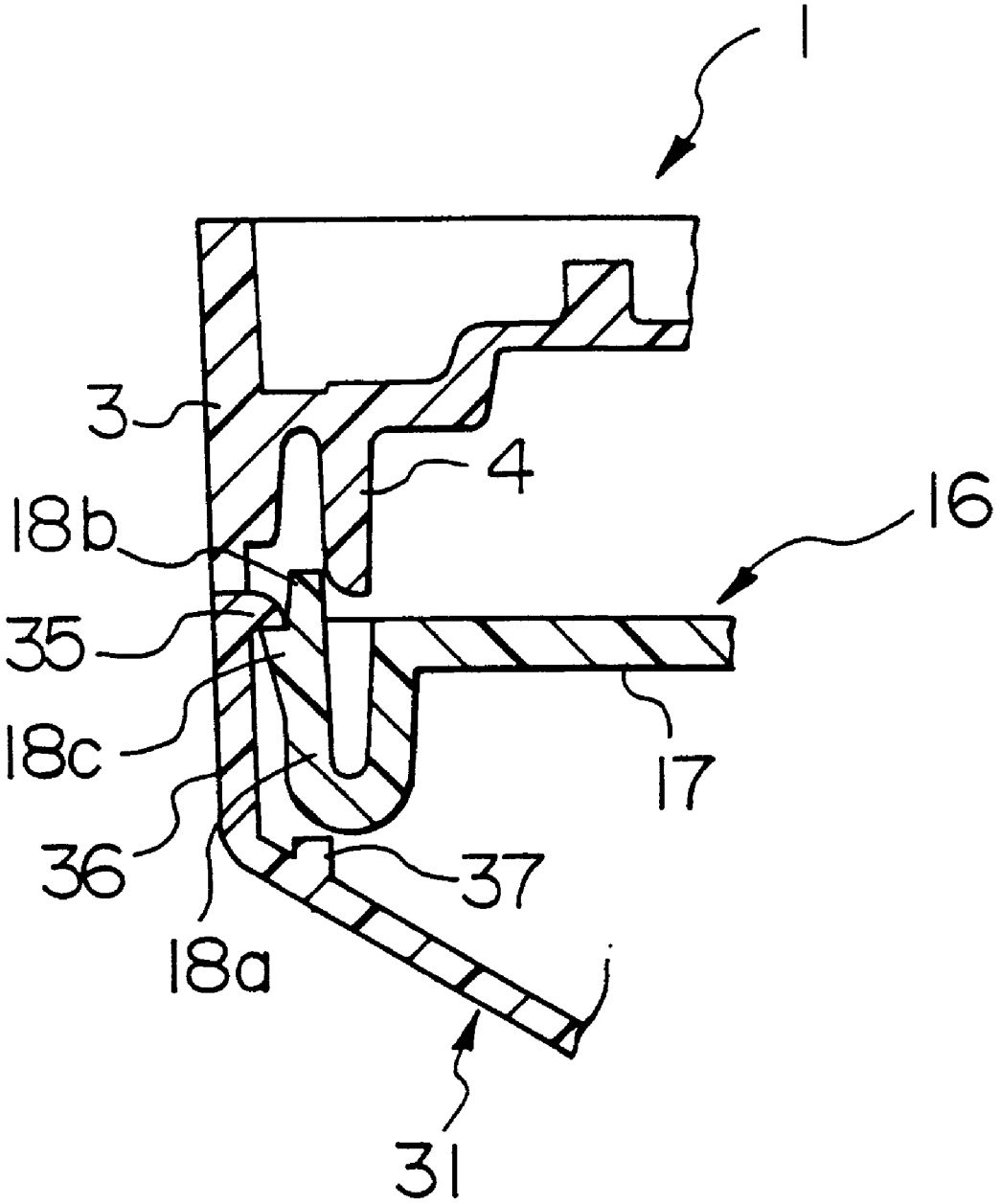
FIG. 11 is a vertically sectional view of the principal portion of the attachment structure which includes the base, the body and the outer cover, of the ionization smoke detector.

As shown in FIGS. 1, 10A, and 11, a rib 4 having an approximately cylindrical shape is formed on the base 1 inside of and along a cylindrical outer wall 3. The rib 4 prevents a protruded portion 18*b* of first levers 18*a* which will be described later, from moving inward.

Figure 10B:
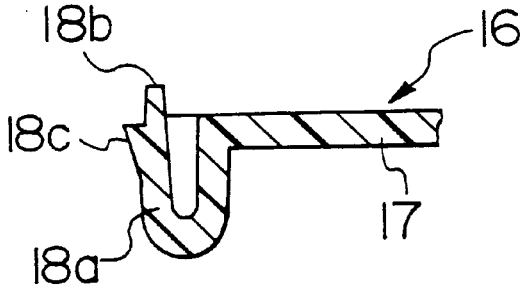

As shown in FIGS. 5, 10B, and 11, the first levers 18*a* and 18*a* serving as pieces for fitting the body 16 in the outer cover 31 are provided for the peripheral wall 18 of the body 16 at two positions. The first levers 18*a* and 18*a* are made of a synthetic resin having elasticity and flexibility and integrated with the body 16.

Moreover, as shown in FIGS. 10B and 11, the first lever 18*a* has a U-shaped cross section. An end of the lever 18*a* is joined to the periphery of the disk portion 17 of the body 16 and the other end thereof is movable along the radial direction of the disk portion 17 due to elastic deformation. That is, the other end of the first level 18*a* can be elastically deformed toward the center of the body 16.

An outward slope portion 18*c* to be fitted to a locking portion 35 of the outer cover 31 which will be described later, is provided on the outer surface near the other end of the first lever 18*a*, as shown in FIG. 10B. The slope portion 18*c* is formed so that the outward thickness thereof becomes larger as the position is the upper. The other end of each first lever 18*a* has a protruded portion 18*b* having a small thickness and protruding upward from the upper end surface of the slope portions 18*c* so that a step is formed between the slope portion 18*c* and the protruded portion 18*b*.

As shown in FIG. 5, a second lever 18*d* serving as a fitting piece for fitting the body 16 in the outer cover 31 is provided on the peripheral wall 18 of the body 16. Though the second lever 18*d* basically has the same function as that of the first lever 18*a*, it has a width larger than that of the first lever 18*a* and moreover has slope portions 18*c* and 18*c* like the first lever 18*a*, at its right and left.

Furthermore, a plurality of ribs 18*e* for preventing the outer cover 31 from rotating to the body 16 are formed on the outer surface of the peripheral wall 18 of the body 16 so as to vertically extend.

Figure 10C:
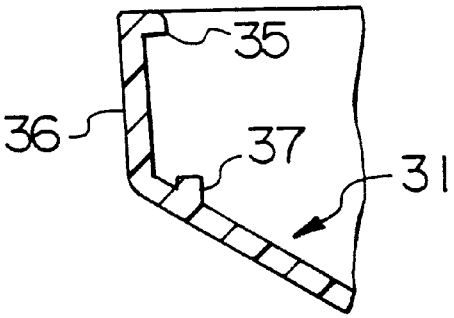

As shown in FIGS. 10C and 11, a cylindrical portion 36 enclosing the outer periphery of the boy 16 is formed on the periphery of the outer cover 31 and the locking portion 35 protruding inwardly is provided at positions corresponding to the slope portions 18*c* of the first lever 18*a* and the second lever 18*d* of the body 16, on the inner surface of the cylindrical portion 36.

Moreover, a protrusion 37 for preventing play produced when setting the outer cover 31 to the body 16 is formed on the inner surface of the outer cover 31, at positions corresponding to the lower ends of the first lever 18*a* and second lever 18*d* having a U-shaped cross section.

Furthermore, grooves which are not-illustrated, corresponding to the ribs 18*e* of the body 16 are formed in the inner surface of the cylindrical portion 36 of the outer cover 31 and the ribs 18*e* of the body 16 engages with the groove of the outer cover 31 to prevent the outer cover 31 from rotating to the body 16.

When the outer cover 31 is set to the body 16, the slope of the slope portion 18*c* is brought into contact with the locking portion 35 protruded from the inner surface of the cylindrical portion 36 on the outer periphery of the outer cover 31, the first levers 18*a* and 18*a* and the second lever 18*d* are elastically deformed toward the center of the body 16 by the slope of the slope portion 18*c*, and the locking portion 35 of the outer cover 31 exceeds the slope portion 18*c* and is engaged with the slope portion 18*c*.

The protruded portion 18*b* is protruded upwardly from the body 16 and outer cover 31 so that the fitting state between the locking portion 35 and the slope portion 18*c* can be released by applying your finger to the protruded portion 18*b* from the upper side of the disk portion 17 and bending the other end of the lever 18*d* inwardly.

As described above, when setting the body 16 to the base 1 while fitting the locking portion 35 of the outer cover 31 to the slope portion 18*c* of the first lever 18*a*, movement of the protruded portion 18*b* toward the center of the body 16 is prevented by the rib 4 of the base 1 as shown in FIG. 11. Therefore, while setting the body 16 to the base 1, it is impossible to release the fitting state between the slope portion 18*c* of the first lever 18*a* of the body 16 and the locking portion 35 of the outer cover 31.

Next, a method for assembling the ionization smoke detector having the above structure will be explained, as follows.

First, the base 1 made of a synthetic resin, body 16 and outer cover 31, outer chamber 12 made of a conductive resin, supporter 22 made of a resin with a high insulation resistivity, printed circuit board on which the circuit part 13 and inner electrode 19 are mounted, and other members are manufactured.

Then, terminals 2 are set to the base 1.

In the detector body 11, the intermediate electrode 20 is set to the intermediate electrode supporting portion 23 of the supporter 22 and the FET 21 is stored in the FET storing portion 24, as shown in FIG. 2.

In order to set the intermediate electrode 20 to the electrode supporting portion 23, the projections 27*d* and 27*d* of the mount 27*c* of the electrode supporting portion 23 are inserted into the attachment holes 20*d* and 20*d* of the intermediate electrode 20 and the electrode piece 20*c* of the intermediate electrode 20 is set in the first notch portion 26*c* of the peripheral wall 26 of the electrode supporting portion 23 to mount the intermediate electrode 20 on the mount 27*c*.

On the other hand, in order to store the FET 21 in the FET storing portion 24 of the supporter 22, three lead wires 21*a*, 21*b*, and 21*c* of the FET 21 are disposed in the second notch portions 24*a*, 24*b*, and 24*c* of the FET storing portion 24, respectively.

In this case, the lead wire 21*a* of the FET 21 to be joined with the intermediate electrode 20 is disposed to the second notch portion 24*a* provided for the FET storing portion 24 so as to face the first notch portion 26*c* of the peripheral wall 26.

Furthermore, the opening of the FET storing portion 24 in which the FET 21 is stored is blocked by a sealing member to seal the FET 21.

When arranging the intermediate electrode 20 and the FET 21 as described above, the electrode piece 20*c* of the intermediate electrode 20 is brought into contact with the lead wire 21*a* of the FET 21 and thus it is possible to easily solder the electrode piece 20 with the lead wire 21*a*.

That is, by arranging the intermediate electrode 20 and the FET 21, as described above, it is possible to easily position the intermediate electrode 20 and the FET 21 so that the electrode piece 20*c* of the intermediate electrode 20 is brought into contact with the lead wire 21*a* of the FET 21.

For soldering, it is possible to prevent the supporting member 25 from interrupting soldering or from deforming or melting due to the heat of soldering because the supporting member 25 for joining the intermediate electrode supporting portion 23 of the supporter 22 with the FET storing portion 24 is disposed at a position a little distant from the joint between the electrode piece 20 and the lead wire 21*a*.

Further, the supporting member 25 disposed as described above enables performance of the soldering from the side opposite to the opening of the FET storing portion 24, without being interrupted by the supporting member 25, as the result, it is possible to prevent insulation between the terminals of the FET 21 from deterioration due to adhesion of flux. On the contrary, if soldering is performed from the side of the opening of the FET storing portion 24, there is a large possibility of flux contained in solder adhered onto the terminals of the FET 21 through the opening of the FET storing portion 24, to deteriorate the insulation of the terminals.

As shown in FIG. 2C, the intermediate electrode 20 is secured to the mount 27*c* by heating the projections 27*d* and 27*d* of the mount 27*c* by using the pressing member 40 and simultaneously pressing the projections 27*d* and 27*d* against the mount 27*c* and melting the upper ends of the projections 27*d* and 27*d* while pressing them against the intermediate electrode.

Therefore, because the intermediate electrode 20 can be secured to the mount 27*c* only by pressing the pressing member 40 against the projections 27*d* and 27*d*, it is possible to easily fix the intermediate electrode 20 in comparison with the case of securing the intermediate electrode 20 to the mount 27*c* with screws. Because the intermediate electrode is fixed with a melted resin, backlash due to a loosened screw does not occur in the intermediate electrode 20 or the electrode 20 is not removed differently from the case of fastening the electrode 20 by screws. Furthermore, because the projections 27*d* and 27*d* are integrated with the supporter 22, the number of members does not increase, in comparison with the case of using screws and bolts.

Next, the supporter 22 to which the intermediate electrode 20 and the FET 21 are set is fitted and secured to the position where the inner electrode 19 of the printed circuit board 13 is attached, and the lead wires 21*b* and 21*c* of the FET 21 are soldered to predetermined positions of the printed circuit board 13 to secure the printed circuit board 13 to the body 16.

The assembling sequence is not restricted to the above sequence. For example, it is also possible to set the supporter 22 to a printed circuit board and then set the intermediate electrode 20 and the FET 21 to the supporter 22.

Then, the outer chamber 12 in which the red lens 12*h* is fitted in the lens attachment hole 12*g* is previously set to the body 16.

In this case, as shown in FIG. 7, the nut 30*a* is previously disposed under a not-illustrated through-hole of the printed circuit board 13 in the body 16.

The pawl portion 12*f* of the outer chamber 12 is fitted in the fitting hole 17*a* of the body 16.

The position of the cylindrical portion 12*e* for screw of the outer chamber 12 is adjusted to coincide with the position of the above through-hole of the printed circuit board 13, and the screw 30*b* is inserted into the cylindrical portion 12*e* for screw to set the screw 30*b* to the nut 30*a*, and thereby the printed circuit board 13 and the outer chamber 12 are fastened to each other.

In this case, the printed circuit board 13 is brought into contact with the front end surface of the cylindrical portion 12*e* for screw of the outer chamber 12, and thus the printed circuit board 13 is electrically connected with the outer chamber 12.

As described above, when setting the outer chamber 12 to the body 16, it is unnecessary to fasten the body 16 or the printed circuit board 13 secured to the body 16, and the outer chamber 12 at a plurality of positions in order to position and secure the outer chamber 12 to the body 16 because the pawl portion 12*f* of the outer chamber 12 is fitted to the body 16. Therefore, because it is enough to fasten only one place in order to secure the electrical connection between the printed circuit board 13 and the outer chamber 12, it is possible to decrease the number of members for fastening, e.g., screws and bolts, and to omit some of time required for fastening.

Because the pawl portion 12*f* is formed while protruding to the outside of the outer chamber 12 and the fitting hole 17*a* to be fitted to the pawl portion 12*f* of the body 16 is also formed outside of the wall portion 12*b* formed on the periphery of the outer chamber 12, water collected on the upper side of the body 16 due to dew condensation does not enter the outer chamber 12 even when the water flows downwardly from the fitting hole 17*a*.

Therefore, the circuit part 14 and the detecting part 15, arranged in the outer chamber 12 are not influenced due to water.

When setting the outer chamber 12 to the body 16, as described above, the LED 29 surface-mounted on the printed circuit board 13 and the red lens 12*h* are arranged so as to be faced each other, as shown in FIG. 9. Thus, it is possible to lead the light of the LED 29 surface-mounted on the printed circuit board 13 covered with the outer chamber 12 to the outside of the outer chamber 12 by the red lens 12*h*.

Because the LED 29 is the surface-mountable type and electrodes of the LED 29 are directly soldered to the printed circuit board 13, the position of the LED is not deviated due to a bent lead wire and the direction of the optical axis is not changed differently from the case of using discrete parts having lead wires for an LED.

Further, because the lens attachment hole 12*g* of the outer chamber 12 provided to emit the light of the LED 29 surface-mounted on the printed circuit board 13 outwardly is blocked by the red lens 12*h*, it is possible to prevent the ingress of dirt and dust through the lens attachment hole 12*g*.

Next, the base 1 is secured to, for example, a ceiling, and wiring is carried out to the terminals 2 of the base 1. The outer cover 31 is set to the body 16.

In this case, by adjusting so that the positions of the locking portions 35 on the inner surface of the cylindrical portion 36 of the outer cover 31 coincide with the positions of the first levers 18*a* and 18*a* and second lever 18*d* of the body 16 and by covering the body 16 with the outer cover 31, the slopes of the slope portions 18*c* provided on the outer surfaces of the first levers 18*a* and 18*a* and second lever 18*d* are brought into contact with the locking portions 35.

By further deeply covering the body 16 with the outer cover 31, the locking portion 35 moves so as to exceed the slope of the slope portion 18*c* and the first levers 18*a* and 18*a* and second lever 18*d* are elastically deformed toward the center of the body 16.

When the locking portion 35 completely exceeds the slope of the slope portion 18*c*, the step on the slope portion 18*c* engages with the locking portion 35, and thus the outer cover 31 is set to the body 16.

When the body 16 with the set outer cover 31 is installed to the base 1, the rib 4 of the base 1 is disposed at a position in the central side near the protruded portion 18*b* of the first lever 18*a* of the body 16, as shown in FIGS. 10A to 10C, so that the first lever 18*a* is prevented from elastically deforming toward the center of the body 16. Therefore, when the protruded portion 18*b* of the first lever 18*a* overlaps with the rib 4 of the base 1 by such an installation, the engagement between the step on the slope portion 18*c* and the locking portion 35 does not permit release thereof.

Therefore, when setting the body 16 to the base 1 or removing the body 16 from the base 1, it is unnecessary to prevent the outer cover 31 from being removed and therefore it is possible to improve the operabilities for assembling and maintaining the ionization smoke detector.

Moreover, even if an operator touches the ionization smoke detector during an performance test, the outer cover 31 does not fall off.

Because the protruded portion 18*b* of the first lever 18*a* protrudes toward the base 1 from the slope portion 18*c* and the protruded portion 18*b* is formed by protruding beyond the outer cover 31 and the portion of the body 16 except the protruded portion 18*b* therearound, it is possible to release the engagement between the slope portion 18*c* of the first lever 18*a* and the locking portion 35 of the outer cover 31, easily to remove the outer cover 31 from the body 16, and to improve the operability of maintenance, by applying the operator's finger to the protruded portion 18*b* to elastically deform the first lever 18*a* toward the center of the body without using a tool such as a screwdriver when removing the outer cover 31 from the body 16 for maintenance.

As described above, according to the ionization smoke detector of the embodiment, it is possible to easily set the intermediate electrode 20 and the FET 21 to be joined to the intermediate electrode 20 by using the above-described supporter 22.

Further, it is possible to decrease the number of parts such as screws when setting the intermediate electrode 20 and outer chamber 12, and to decrease the number of screw fastening portions and therefore to improve the operability when assembling the ionization smoke detector.

Furthermore, it is possible to prevent the printed circuit board 13 and the like from being brought into contact with water produced due to dew condensation even if the water comes in through the fitting hole 17 by arranging the fitting hole 17 outside the outer chamber 12 when fitting the pawl portion 12*f* of the outer chamber 12 in the fitting hole 17*a* of the body 16.

By using the surface-mounting-type LED 29 as an operation indicator, it is possible to simplify assembling and to prevent the ingress of dirt and dust into the side of the printed circuit board 13 in comparison with the case of using a discrete-type LED.

By using the above-described structure for setting the body 16 and outer cover 31, it is possible to prevent the outer cover 31 from falling off and easily to remove the outer cover 31 from the body 16.

According to the ionization smoke detector of the present invention, because the first notch portion formed in the cylindrical peripheral wall, for extending the electrode piece of the intermediate electrode out of the cylindrical peripheral wall, is arranged facing the second notch portion formed in the container, for extending a lead wire of the FET out of the container, it is possible to bring the electrode piece extending from the first notch portion into contact with the lead wire extending from the second notch portion by setting the intermediate electrode to the electrode supporting portion so that the electrode piece of the intermediate electrode extends outwardly through the first notch portion and by containing the FET in the container so that the lead wire of the FET extends outwardly through the second notch portion.

Because the positioning of the intermediate electrode and the FET, and the joining of them can be easily performed, it is possible to improve the operability for assembling an ionization smoke detector and to decrease the production costs of the ionization smoke detector.

What is claimed is:

1. An ionization smoke detector comprising:

an inner electrode;

an intermediate electrode having an electrode body and an electrode piece extending from the electrode body, facing the inner electrode and connected to a field effect transistor;

an outer electrode provided in an opposite side to the inner electrode with respect to the intermediate electrode; and an insulating supporter for supporting the intermediate electrode to face the inner electrode; wherein the supporter comprises an electrode supporting portion for supporting the intermediate electrode, having a cylindrical peripheral wall to enclose the electrode body of the intermediate electrode, a container for containing the field effect transistor, and a container supporting member for supporting the container by connecting it to the electrode supporting portion;

a first notch portion for extending the electrode piece of the intermediate electrode out thereof is formed in the cylindrical peripheral wall, and a second notch portion for extending a lead wire of the field effect transistor stored in the container out of the container is formed at a position facing the first notch portion of the peripheral wall; and the electrode piece extending from the first notch portion is connected to the lead wire extending from the second notch portion.

2. An ionization smoke detector as claimed in claim 1; wherein the electrode supporting portion of the supporter comprises an electrode mount for supporting the intermediate electrode, having a projection thereon which passes through an attachment hole formed in the intermediate electrode and an upper end of which is deformed to secure the intermediate electrode to the electrode mount so that the intermediate electrode faces the inner electrode.

3. An ionization smoke detector as claimed in claim 1; wherein the electrode supporting portion of the supporter comprises an electrode mount for supporting the intermediate electrode, having a projection thereon which passes through an attachment hole formed in the intermediate electrode, and the intermediate electrode is secured to the electrode mount by melting an upper end of the projection passing through the attachment hole of the intermediate electrode while mounting the intermediate electrode on the electrode mount.

4. An ionization smoke detector as claimed in claim 1; wherein the container supporting member is arranged apart from the connected portion between the electrode piece extending from the first notch portion and the lead wire extending from the second notch portion.

5. An ionization smoke detector comprising:

a detecting part having an inner electrode, an intermediate electrode facing the inner electrode, and an outer chamber functioning as an outer electrode provided in an opposite side to the inner electrode with respect to the intermediate electrode;

a circuit part having a printed circuit board on which an electronic part for detecting smoke in accordance with an output from the detecting part is mounted; and a supporting body to which the detecting part and the circuit part are installed;

wherein the printed circuit board is secured to the supporting body, the outer chamber and the printed circuit board are in contact with and electrically connect to each other at least at one position, and a fitting means to be fitted to the supporting body is provided on the outer chamber.

6. An ionization smoke detector as claimed in claim 5; wherein the outer chamber is made of an electrically conductive resin.

7. An ionization smoke detector as claimed in claim 5; wherein the circuit part and the detecting part except the outer chamber are arranged between the supporting body and the outer chamber disposed under the supporting body while the bottom of the detecting part is covered with the outer chamber, and the fitting means is provided to protrude outwardly from the peripheral portion of the outer chamber and a fitting hole in which the fitting means is fitted is formed at a position corresponding to the fitting means of the supporting body.

8. An ionization smoke detector as claimed in claim 5; wherein a surface-mounting-type of a light-emitting device for giving an operational indication is provided on a surface of the printed circuit board facing the outer chamber, a through-hole is formed at a position corresponding to the light-emitting device in the outer chamber, a light-transmissive member for introducing the light emitted from the light-emitting device out of the outer chamber is disposed in the through-hole, and the through-hole is blocked by the light-transmissive member.

9. An ionization smoke detector comprising:

a base secured to a portion such as a ceiling;

a detector body removably set to the base and having a smoke detecting means for detecting smoke; and an outer cover for covering the opposite side to the base of the detector body; wherein the detector body has a supporting body for supporting the smoke detecting means, which is removably set to the base and to a peripheral portion of which an outer cover is held;

a fitting piece elastically deformable toward the center of the supporting body, having a protrusion protruding outwardly, and extending toward the base is provided on the peripheral portion of the supporter;

a cylindrical portion surrounding the peripheral portion of the supporter is formed on an outer peripheral portion of the outer cover and a fitting portion to be fitted to the protrusion of the fitting piece is formed on an inner surface of the cylindrical portion; and the base is provided with a preventing portion for preventing an elastic deforming of the fitting piece from elastically deforming toward a central side of the supporting body, the preventing portion being arranged in a central side of the fitting piece so as to overlap with the fitting piece.

10. An ionization smoke detector as claimed in claim 9; wherein the fitting piece is made of a synthetic resin having elasticity and flexibility and has a U-shaped cross section which is elastically deformable easily by a finger.

* * * * *